US007249725B2

(12) United States Patent
Klaeui et al.

(10) Patent No.: US 7,249,725 B2
(45) Date of Patent: Jul. 31, 2007

(54) THREAD CARRYING APPARATUS AND A TEXTILE MACHINE, IN PARTICULAR A WEAVING MACHINE, INCLUDING A THREAD CARRYING APPARATUS FOR THIS KIND

(75) Inventors: Erich Klaeui, Seuzach (CH); Hans-Dieter Scorl, Rueti (CH)

(73) Assignee: Sultex AG, Ruti (CH)

( * ) Notice: Subject to any disclaimer, the term of this patent is extended or adjusted under 35 U.S.C. 154(b) by 175 days.

(21) Appl. No.: 10/688,386

(22) Filed: Oct. 16, 2003

(65) Prior Publication Data

US 2004/0099329 A1 May 27, 2004

(30) Foreign Application Priority Data

Nov. 22, 2002 (EP) ..... 02406014

(51) Int. Cl.
*B65H 57/00* (2006.01)

(52) U.S. Cl. ..... 242/157.1; 242/615.2

(58) Field of Classification Search ..... 242/365, 242/365.3, 365.6, 366.2, 615, 615.2, 157.1
See application file for complete search history.

(56) References Cited

U.S. PATENT DOCUMENTS 3,113,225 A * 12/1963 Claus et al. ..... 310/26
4,744,394 A * 5/1988 Lincke ..... 139/452
4,807,450 A * 2/1989 Weiland ..... 66/84 A
5,152,444 A * 10/1992 Saito ..... 242/615
5,263,625 A * 11/1993 Saito ..... 242/615
5,301,864 A * 4/1994 Saito et al. ..... 242/358
5,319,506 A * 6/1994 Kojima et al. ..... 360/73.05
5,377,893 A * 1/1995 Saito ..... 242/615
5,425,487 A * 6/1995 Saito et al. ..... 242/615.3
5,947,162 A * 9/1999 Steiner et al. ..... 139/28

FOREIGN PATENT DOCUMENTS

| | | |
|---|---|---|
| EP | 1375589 A | 11/1974 |
| EP | 0 508 769 A2 | 10/1992 |
| EP | 1 126 083 A2 | 8/2001 |
| JP | 08254427 A | 4/1998 |
| WO | WO 94/18674 A1 | 8/1994 |

* cited by examiner

*Primary Examiner*—Patrick Mackey
*Assistant Examiner*—William E. Dondero
(74) *Attorney, Agent, or Firm*—Townsend and Townsend and Crew LLP

(57) ABSTRACT

In accordance with the invention a thread carrying apparatus is proposed with a thread (2) lying in contact with or passing along the thread carrying apparatus with friction in the operating state. The thread carrying apparatus includes excitation means (3) for producing oscillations which reduce the frictional force between the thread (2) and the thread carrying apparatus. In this arrangement a resonator body (4) is provided with the thread (2) lying in contact with or passing along the resonator body with friction in the operating state. The resonator body (4) is designed in such a manner that the excitation means (3) produce resonant structural sound oscillations in the resonator body (4).

11 Claims, 7 Drawing Sheets

THREAD CARRYING APPARATUS AND A TEXTILE MACHINE, IN PARTICULAR A WEAVING MACHINE, INCLUDING A THREAD CARRYING APPARATUS FOR THIS KIND

BACKGROUND OF THE INVENTION

The invention relates to a thread carrying apparatus and to a textile machine, in particular to a weaving machine, which includes a thread carrying apparatus which reduces the frictional force between the thread and the thread carrying apparatus.

Components in machines of all kinds which are in contact with rapidly moved threads, with the threads also frequently being pressed against the corresponding component with great force, are subject to special stresses through frictional forces. In this the negative influences of course affect not only the components which carry the threads, but in particular also the threads themselves, which also suffer as a result of the frictional forces.

In the context of this application, components of machines of all kinds which are in contact with threads are designated as thread carrying elements. In this context the threads can be temporarily or permanently guided over or at a surface of the thread carrying element or lie in contact at a surface of the thread carrying element in the operating state. In this context the term thread shall in the following include in particular textile threads, especially also threads in the form of little bands, including, for example, wool, cotton or silk, or yarns or twines such as e.g. paper yarns, celluloid yarns or synthetic yarns of perlon, nylon, dralon or other synthetic materials, as well as threads in the broadest sense of the word, that is, for example, also threads of glass, metal or other materials.

A category of machines which is important in practice and which has a large number of thread carrying elements of the most diverse kinds is textile machines in the broadest sense of the word and thus in particular weaving machines in the most varied embodiments. In these machines, threads are guided by thread carrying elements, partly at extremely high speeds and in the presence of strong pressing forces. In this connection the thread carrying elements can for example be arranged as simple deflection elements, such as deflection rollers, which can either be arranged to be stationary or to be rotatable about an axis, or can be designed as eyes through which the thread passes. Moreover, a thread carrying element can however for example also be a drum store of a weaving machine or a thread supply device of a knitting machine, or a thread guiding element of a weaving rotor of a multiple-phase weaving machine. Of course, as already mentioned, the term thread carrying element is not intended in the context of this invention to be restricted to the above-described examples, and also not to textile machines.

Particularly strong frictional forces arise at points at which the thread is guided at or over the thread carrying element at high speed. In this, considerable heat development can then occur locally, which can lead to intolerable temperature increases and/or to temperature gradients in the material of the thread carrying element itself and in further neighboring system components. In particular the thread can be damaged in the process which, for example in the case of weaving, can lead to the weaving product having a clearly poor quality. A further problem is often the aggressive abrasive behavior of the thread in cooperation with the discussed frictional effects, which can lead among other things to a premature wear of the thread carrying element.

This is a problem which is well known for example in thread guiding elements of weaving rotors of multiple-phase weaving machines and plays a considerable role there. Thus in this kind of weaving machine the friction at the thread guiding elements is an essential parameter for the performance of these machines. The friction which the thread experiences during its passage at the numerous deflection points at the thread guiding elements is one of the most important performance limiting factors in multiple-phase weaving machines. Moreover, frictional effects impair the quality of the weaving products and restrict the article spectrum of the machine.

Moreover, in thread carrying elements against which the thread is not pressed with a great force and in which the heat development remains within bounds, such as for example in a thread drum of a drum store of a weaving machine, the friction between the thread and the thread carrying element can have a clearly negative influence on the operation of the machine. In the operation of weaving machines for example in the processing of weft yarns, in particular of weft yarns in the form of little bands, which tend to stick to the thread carrying elements, it has been shown that the friction at the thread carrying elements which respectively carry or guide the weft yarn plays an important role. In this the sticking of the thread to the thread carrying element is frequently also enhanced by substances which are carried along by the thread such as oil, wax, size or other substances.

In studies of the operating behavior of weaving machines it was found in particular that a reduction of the friction can contribute to significantly increasing the presently existing limit of the weft insertion performance. In this a particular significance is accorded to the thread storage of the weaving machine with respect to the influence of the friction in the drawing off of the weft thread during the weft insertion. The maximum speed with which the weft thread can be inserted into the shed is limited, not least by the level of the friction between the weft thread and the thread drum during the drawing off of the weft thread from the thread drum. Moreover, additional tensile forces arise of course in the weft thread as a result of the friction (between the thread drum and the weft thread) which stress the thread, which, in particular in fine fabrics or, in the case of weft threads which are plastically or elastically deformable under certain tensile loadings, can quite noticeably negatively influence the quality of the woven product.

Different ideas are known for reducing the friction at thread carrying elements. For example the wear which is caused through friction mechanisms can be reduced by providing the thread carrying elements with particularly low-friction coatings, such as for example with ceramics, or by equipping the threads with friction reducing lubricants. Measures of this kind are admittedly often suitable for reducing the friction between the thread carrying element and the thread to a certain extent; a not insignificant portion of residual friction is, however, unavoidable. In addition a suitable processing or coating respectively of the frictional surfaces of the thread carrying elements does not lead to the desired success in all cases, and in particular the use of friction reducing lubricants can easily have a negative influence on certain thread carrying elements, such as for example on the drum store of a weaving machine, depending on the kind of the thread. Their use is also often prohibited for technical reasons.

An alternative idea for reducing the friction between the thread and the thread carrying element is presented for example in EP 1 126 063 A2, which proposes a friction purveyor or thread regulating wheel for a knitting machine which has a vibration producing unit which acts on the thread. In this the thread, which is supplied to a thread supply wheel which is rotationally fixedly connected to a drive shaft, is guided by a thread guiding element in the form of an eye, with the eye being connected to a device which sets the eye and thus the thread into oscillation. In this the eye which guides the thread executes, at each rotation of the thread supply wheel, an oscillatory movement of low amplitude, which is also transferred to the thread, through which the friction between the thread and the rotating thread supply wheel is reduced. In this the eye is mechanically connected to a rotating shaft of the knitting machine via an eccentric mechanism or is driven via an electromagnet which is supplied with a low frequency voltage.

Although a certain reduction of the frictional forces between the thread and the thread supply wheel can be achieved with the thread regulating wheel which is shown in EP 1 126 063 A2, this technique has considerable disadvantages and can be used elsewhere only with restrictions.

One of the serious disadvantages of this apparatus consists in that the eye must move the thread back and forth with a certain amplitude to transfer the vibration to the thread, which means that the source which excites the thread, that is, the eye, must execute a center-of-gravity movement as a whole. In this the force transmission in order to set the thread oscillating over a considerable length takes place quasi point-wise at the location at which the thread lies in contact at the eye. This has the consequence that the thread is continually charged with a considerable point-like tensile loading and with a considerable bending stress in the direction of the oscillatory movement of the eye, which is particularly disadvantageous. From this there of course also results a correspondingly large tensile stress in the direction of the thread. In very sensitive threads, in particular in threads of low breaking resistance, this method can hardly be used without damaging the thread and thus diminishing the quality of the finished product. Depending on the constitution of the thread the use can even be impossible. A further problem consists in that the oscillations are coupled in only at one point of the thread or at few points of the thread which are spaced from one another. This has the consequence that the thread is not uniformly loaded with the oscillations, since with increasing distance from the oscillating thread carrying eye the vibrations in the thread are increasingly more strongly damped. Through this the friction between the thread carrying element and the thread is not uniformly reduced when considered over the length of the thread, which can result in a non-uniform guiding of the thread, for example when drawing the thread off from a drum store. The result can be pulsating mechanical stresses in the thread, which can lead to an unacceptable reduction in quality of the product, for example during the insertion of a weft thread, in particular during the weaving of fine high quality cloths.

Since the charging of the thread with vibrations takes place in principle through a relatively high amplitude center-of-mass movement of a thread carrying element, for example through an oscillating eye through which the thread passes, the thread can be charged only with relatively low frequency vibrations, which are particularly easily transmitted to other system components of the machine. Moreover, the vibrations in the thread are already relatively highly damped down at a short distance from the point at which the oscillation is excited by the eye. Above all, however, for reasons of work protection legislation as well, such low frequency excitations in the audible range are more than precarious. Moreover, the above-discussed friction purveyor is mechanically very complicated and expensive and thus relatively susceptible to breakdown and is maintenance intensive.

SUMMARY OF THE INVENTION

An object of the present invention is thus to propose another thread carrying apparatus with which the frictional force between the thread and the thread carrying apparatus can be effectively reduced.

The subjects of the invention which satisfy this object are described below.

Thus in accordance with the invention a thread carrying apparatus is proposed at which a thread lies in contact or passes along with friction in the operating state, with the thread carrying apparatus including excitation means for producing oscillations which reduce the frictional force between the thread and the thread carrying apparatus. In this a resonator body is provided at which the thread lies in contact or passes along with friction in the operating state, with the resonator body being designed in such a manner that the excitation means produce resonant structural sound oscillations in the resonator body.

In the operating state a thread lies in contact at a resonator body of the thread carrying apparatus in accordance with the invention or the thread passes along the resonator body of the thread carrying apparatus with friction. For reducing the friction between the thread and the thread carrying apparatus the latter includes excitation means for producing resonant structural sound oscillations in the resonator body which likewise set the thread, which lies in contact at the thread carrying element or passes along it with friction, oscillating, so that the frictional surface which is effective on a time average between the threads and the resonator body is reduced, through which the acting frictional forces which are acting can be significantly reduced.

Since the resonator body which carries the thread is designed in such a manner that the excitation means produce resonant structural sound oscillations in the resonator body, the thread is completely uniformly charged with vibrations over the entire length along which it is in contact with the resonator body of the thread carrying element. The frequency of the oscillations corresponds to those of the resonant structural sound oscillations which are imposed on the resonator body by the excitation means. Through this the frictional force between the thread and the thread carrying apparatus is completely uniformly reduced over the entire length over which it is in contact with the resonator body of the thread carrying element, since damping effects of the oscillations of the thread do not come into effect over the entire length over which the thread lies in contact with the thread carrying element. Therefore, in the guiding of the thread over the thread carrying element no undesirable pulsating or temporally and/or spatially varying mechanical tensions arise in the thread. This means that the thread can be guided completely uniformly over the thread carrying element with minimum friction, which is, for example, of particular importance in the drawing off of a weft thread from a drum store of a weaving machine.

Structural sound oscillations are preferably, but not necessarily, excited in the resonator body of the thread carrying element in such a high frequency range that the structural sound is no longer perceptible to the human ear, which is extremely advantageous in particular for reasons of work protection legislation. Structural sound waves with frequencies above 18 kHz, in practice frequently of more than 25 kHz, in particular above 30 kHz, are preferably used.

In this the resonator body can include the excitation means, with it being possible for the frequency range, the kind of structural sound waves produced (transverse waves or longitudinal waves), as well as their polarization to be matched to one another in such a manner that characteristic oscillation frequencies of the resonator body as a whole can be excited. If the thread carrying element is for example realized by the drum of a drum store of a weaving machine, then the structural sound which is coupled in through the excitation means into the drum can be tuned such that the drum as a whole is set into resonant oscillations as a resonator body. In another exemplary embodiment, in which the thread carrying element is realized by a thread guiding element of a multiple-phase weaving machine, the thread guiding element as a whole forms the resonator body of the thread carrying element, to which the structural sound wave which is to be coupled in can then be tuned.

In a preferred exemplary embodiment of a thread carrying element in accordance with the invention, the thread carrying element includes at least one excitation means which is formed as an electromagnetically excitable oscillating element. The electromagnetically excitable oscillating element is preferably designed as a piezoelectric oscillating element which is fed with a suitable frequency from an electrical alternating voltage source. In a special embodiment the piezoelectric oscillating element is designed as an ultrasonic oscillator and forms a so-called half wave resonator; i.e. it is operated through the electrical alternating voltage source at a mechanical resonance of the resonator body. The total length of the resonator body then preferably amounts to just half a resonant wavelength or a multiple thereof. In this the piezoelectric oscillating element itself preferably includes a piezoelectric ceramic, such as for example lead zirconate-titanate, piezoelectric composites or another suitable piezoelectrically active substance. Thus it is possible among other things to build up the piezoelectric oscillating element out of a stack of piezoelectric plastic films, wherein it is possible for a combination of different materials to be helpful in certain cases.

In an example which is important in practice, the resonator body of the thread carrying element includes a first and a second metallic end piece, with a thread carrying surface for the guidance of the thread being arranged at an outer end of the first end piece, and with the piezoelectric oscillating element being suitably arranged between the two end pieces at an inner end of the first end piece which is remote from the thread carrying surface, and with the metallic end pieces together with the piezoelectric oscillating element being held together under a strong bias tension for example through a screw connection. In this arrangement the first end piece, which includes the thread carrying surface, can include for example titanium, magnesium or aluminum, and the second end piece can include for example tungsten, brass or steel. Of course the materials which build up the resonator body, especially those which build up the end pieces, can also include other suitable metals or any other suitable material, in particular also plastics.

In the electrical excitation of the piezoelectric oscillating element with an alternating electrical voltage, the frequency of which corresponds to the mechanical resonant frequency of the resonator body as a whole, the piezoelectric oscillating elements execute a mechanical oscillation, which is resonantly amplified by a multiple factor by the end pieces in a manner which is known per se, which also corresponds to the actual purpose of the end pieces, and which can be transmitted to the thread in the operating state via the thread carrying surface which belongs to the resonator body.

Depending on the kind of piezoelectric oscillating elements used, different oscillation directions can be realized with otherwise the same construction of the resonator body. Thus the piezoelectric oscillating element can execute different oscillatory modes, and thus can, for example, be excited as a transverse (thickness) oscillator, longitudinal oscillator or shear oscillator, or can also be excited to a combination of different oscillation directions. In particular it is possible to suitably combine a plurality of different piezoelectric oscillating elements in one resonator body which execute the same or different oscillatory modes at the same or different frequencies at the same time. In particular the piezoelectric oscillating element can be designed in the form of a bending oscillator, including one or more layers of piezoelectric oscillators, in particular longitudinal oscillators, e.g. of bimorphic strips, with the resonator body preferably being operable in the harmonic or overtone mode. Through this the oscillatory behavior of the piezoelectric oscillating element can be ideally adapted in dependence on the geometry of the resonator body of the thread carrying element, which is as a rule definitely predetermined by the corresponding machine, for example a weaving machine, and is thus not freely selectable, so that the friction between the thread and the thread carrying element can be reduced to a minimum. In addition, the material of the threads to be guided, their geometry (broad flat threads, thin or thick threads, etc.), the surface properties of the thread carrying surface, the treatment of the threads with additional substances such as an oil, with size or other substances, as well as further parameters relevant to the operation, can, for example, also play a role in the determination of the ideal oscillatory mode.

Electromagnetic excitation means other than piezoelectric ones can basically also be considered. In a further embodiment of a thread carrying apparatus at least one excitation means is designed as a magnetostrictive oscillating element which can be excited via an alternating magnetic field, which can likewise be excited to resonant oscillations, for example via a coil which encircles the magnetostrictive oscillating element. The magnetostrictive oscillating element preferably forms a bar-shaped or cylindrical body which is built up of a magnetostrictive material, such as for example iron, cobalt, nickel and their alloys, as well as ferrite or a terbium-dysprosium-iron alloy (terfenol). In this the oscillating element can include in analogy with the above-described case of a piezoelectric oscillator a first and/or a second end piece and/or a thread carrying surface, which again together form the resonator body, which is excited through the magnetostrictive oscillating element to resonant structural sound oscillations, which are transmitted via the thread carrying surface for reducing the friction on the thread. In this, one or even both of the end pieces can be omitted in the case of a magnetostrictive oscillating element, so that the thread carrying surface is arranged directly at the oscillating element, with it also being possible for the oscillating element itself to be suitably designed at one end as a thread carrying surface.

Moreover, other electromagnetically excitable oscillating elements, such as for example electrostrictive oscillating elements or others, can also be advantageously used.

The thread carrying apparatus can also include at least one excitation means which is formed as a mechanically excited oscillating element. Thus the resonator body of the thread carrying apparatus can for example have a rough surface region, e.g. in the form of a fine-toothed surface, which is in active contact with a rotatable or otherwise periodically, for example translationally, movably arranged vibration device.

The vibration device can for example likewise include a rough surface section, which is moved in the operating state relative to and in frictional contact with the rough surface region of the resonator body of the thread carrying apparatus, so that the resonator body is excited to resonant structural sound oscillations. In this the frequency of the resonant structural sound oscillations can be set via the roughness of the surfaces and via the speed of movement of the relative movement of the rubbing partners. Thus, the frequency of the resonant structural sound oscillations can, for example, be set advantageously and in a precisely defined manner in that the rough surface region of the resonator body and/or the rough surface section of the vibration device is/are formed through highly regular nanostructures, for example in the form of a nanostructured toothed surface.

If the thread carrying apparatus includes an electromagnetically excitable oscillating element it is possible for the electromagnetic energy for exciting the oscillating element to be couplable in a wireless manner by means of a transmission device. The transmission device can advantageously include a transformer arrangement with a primary winding core and a secondary winding core which are galvanically separate from one another and which have in each case a primary winding and a secondary winding in a known manner, said transformer arrangement having a resonant electrical circuit on the secondary side which is connected to the electromagnetic oscillating element for the energy supply of the electromagnetic oscillating element. For the transmission of the electrical energy an electrical current of suitable frequency, especially of the frequency of the resonant structural sound oscillations which are to be produced, is fed to the transformer device at the primary side and can be supplied to the electromagnetic oscillating element through inductive coupling of the primary side of the transformer device to the secondary side of the transformer device.

In order to ensure an ideal energy transmission in the transformer device, special requirements are to be placed on the design and the materials of the primary and secondary winding cores in view of the relatively high frequencies of the electrical energy to be transmitted of, for example, more than 18 kHz, 25 kHz or more than 30 kHz and in view of the high powers to be transmitted, which can amount to more than 500 W, especially to more than 1 kW. For the extensive suppression of eddy currents and heat production the winding cores are preferably built up of ferrite, stacked and mutually insulated iron films or of iron powder. Naturally other materials, which are not explicitly named here, can also be advantageously used.

The supply of electrical energy to the electromagnetic oscillating element need not take place inductively by means of a transformer device, but rather can also take place through direct connection to a suitable electrical source, in particular a corresponding alternating current source. In special cases it is also possible for the wireless transmission of electrical energy to be accomplished with optical means, through microwaves or otherwise.

As already mentioned, the resonator body of a thread carrying apparatus in accordance with the invention can among other things also be formed by the thread drum of a drum store of a textile machine, for example, in particular by the thread drum of a drum store of a weaving machine by a thread guiding element of a weaving rotor of a multiple-phase weaving machine or by a thread deflection apparatus, for example by a moved or rigid roller, an eye or another thread deflection apparatus, in particular of a textile machine.

In this, all the explanations made above of course hold analogously for any desired exemplary embodiment of a thread carrying apparatus, with it naturally being possible, for example, for any suitable combination of the described embodiments to be realized in one and the same variant of a thread carrying apparatus depending on the requirements.

Moreover, the invention relates to a textile machine, in particular to a weaving machine, with a thread carrying apparatus in accordance with the invention, such as has been explained above in an exemplary manner with reference to several variants.

BRIEF DESCRIPTION OF THE DRAWINGS

The invention will be explained in more detail in the following with reference to the drawings.

DESCRIPTION OF THE PREFERRED EMBODIMENTS

Figure 1:
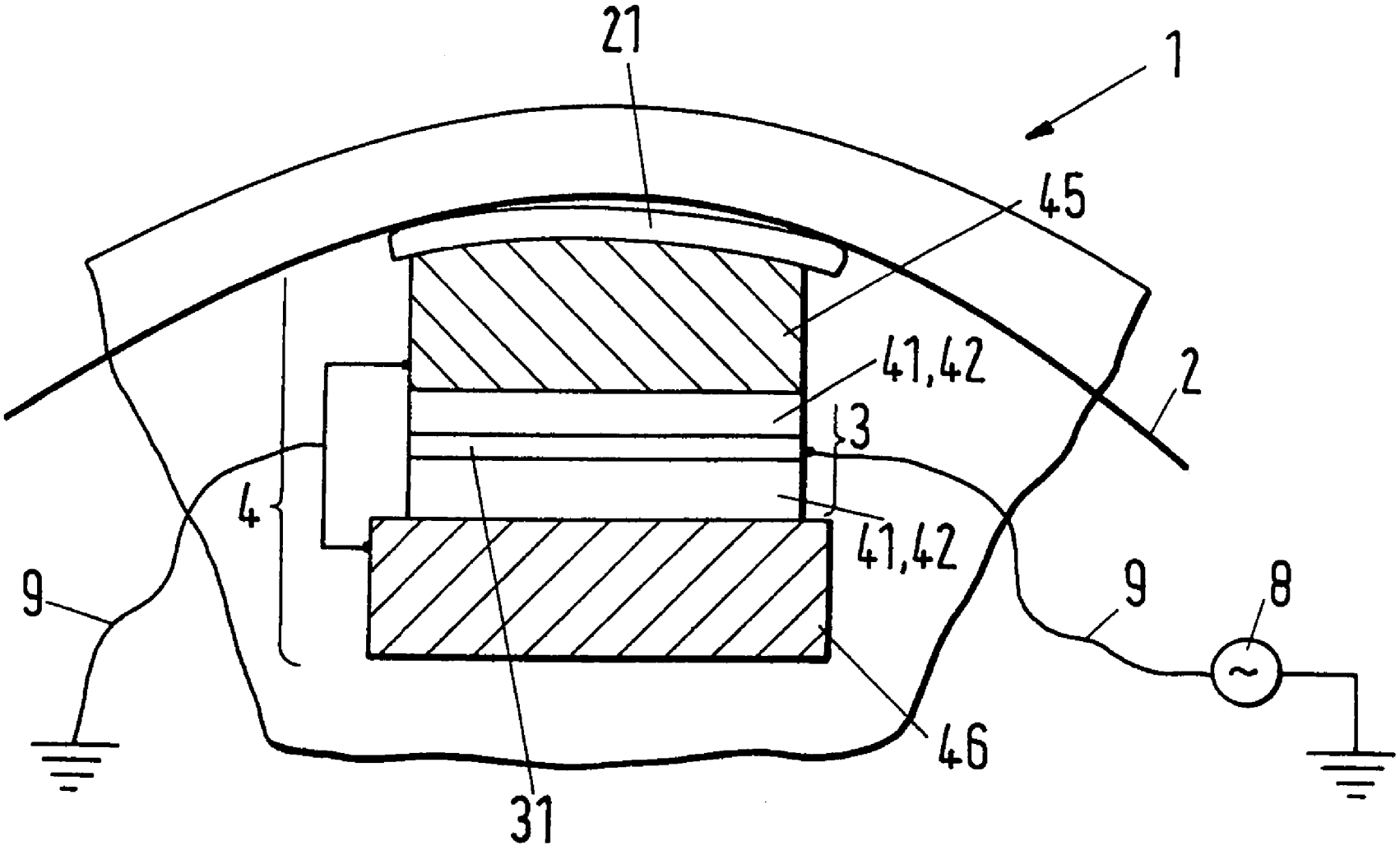
FIG. 1 shows a first exemplary embodiment of a thread carrying apparatus with a piezoelectric oscillating element.

FIG. 1 shows in a schematic illustration a first exemplary embodiment of a thread carrying apparatus, which in the following will be designated in its entirety by the reference numeral 1. The thread carrying apparatus 1 has a resonator body 4 which has excitation means 3 which are formed by two piezoelectric oscillating elements 41, 42. Furthermore, the resonator body 4 includes a first end piece 45 and a second end piece 46, with a thread carrying surface 21 which carries the thread 2, or along which the thread 2 passes, being arranged at an outer end of the first end piece 45. The two piezoelectric oscillating elements 42 are separated from one another by an electrically conducting electrode layer 31 and are arranged in stack-like manner between the first end piece 45 and the second end piece 46. The end pieces 45, 46 form, together with the piezoelectric oscillating elements 41, 42, the electrode layer 31 and the thread carrying surface 21, a resonator body which can be excited to resonant structural sound oscillations by the excitation means 3. In this the excitation means 3 can for example have only one piezoelectric oscillating element 42, with the electrode layer 31 then not being necessary. In another special case the excitation means 3 can also be formed by three or more piezoelectric oscillating elements 42, with each oscillating element 42 being separated from a neighboring oscillating element 42 by a separate electrode layer 31.

In the exemplary embodiment which is shown in FIG. 1 the piezoelectric oscillating elements 42 are connected to an electrical energy source 8 via supply lines 9, with the non-earthed pole of the energy source 8 being connected for safety reasons, in a manner which is known per se, to the electrode layer 31 between the piezoelectric oscillating elements 42, which is insulated relative to the outside. The first end piece 45 and the second end piece 46 are built up of suitable metals and can therefore serve at the same time as electrodes for the two piezoelectric oscillating elements 42. The electrical energy source 8 supplies the piezoelectric oscillating elements 42 with an alternating voltage, preferably at a frequency of more than 18 kHz, in particular of more than 25 kHz. The resonator 4 thus forms an ultrasonic oscillator, which is preferably designed as a half-wave resonator, with the total length of the resonator 4 corresponding to half a resonant wavelength or a multiple thereof. The end pieces 45, 46 and the piezoelectric oscillating element 42 with the electrode layer 31 are held together under a strong bias force by non-illustrated securing means, in particular by a screw connection. The first end piece 45 can for example include titanium, magnesium or aluminum, whereas the second end piece 46 can preferably be built up of tungsten, brass or steel. On electrical excitation of the piezoelectric oscillating elements 42 with an alternating voltage from the electrical energy source 8, the frequency of which corresponds to the mechanical resonance frequency of the resonator body 4, the piezoelectric oscillating elements 42 execute mechanical oscillations, which are amplified by a multiple factor through the end pieces 45, 46 and are transmitted by means of the first end piece 45 via the thread carrying surface 21 to the thread 2, through which the frictional force between the thread 2 and the thread carrying element 1 can be minimized to a very small value in the neighborhood of zero.

Figure 2:
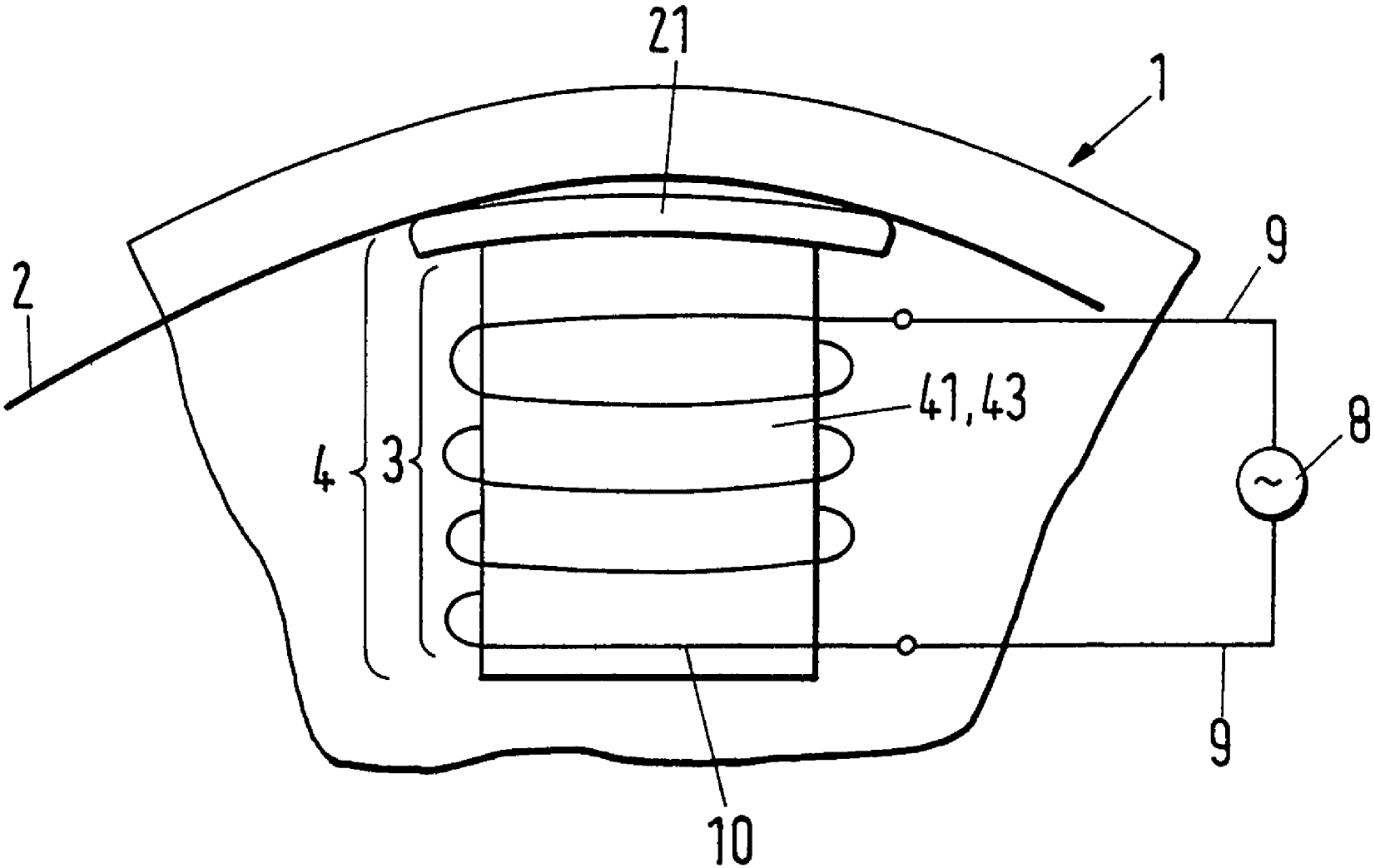
FIG. 2 shows a second exemplary embodiment in accordance with FIG. 1 with a magnetostrictive oscillating element.

FIG. 2 shows a second exemplary embodiment in accordance with FIG. 1 with a magnetostrictive oscillating element 43. The resonator 4 with the magnetostrictive oscillating element 43 likewise has as a contact surface to the thread 2 a thread carrying surface 21, to which the oscillating element 43 is firmly actively coupled. The magnetostrictive oscillating element, which can include in particular iron, cobalt, nickel and/or their alloys, ferrite, terfinol or other suitable magnetostrictive materials, is especially, but not necessarily, designed in the form of a polygon, e.g. with a rectangular base area, and includes a coil 10 which is connected via the supply lines 9 in a manner which is known per se to the electrical energy source 8, which supplies an alternating electrical voltage with a frequency, such that, through the electromagnetic coupling of the coil 10 to the magnetostrictive material of the oscillating element 43, the oscillating element 43 is excited to a resonant oscillation, which, as already described above, can be transmitted to the thread 2 via the thread carrying surface 21. Of course a yoke arrangement, which is known per se, or any other suitable form also enters into consideration for the form of the resonator body 4.

Figure 3:
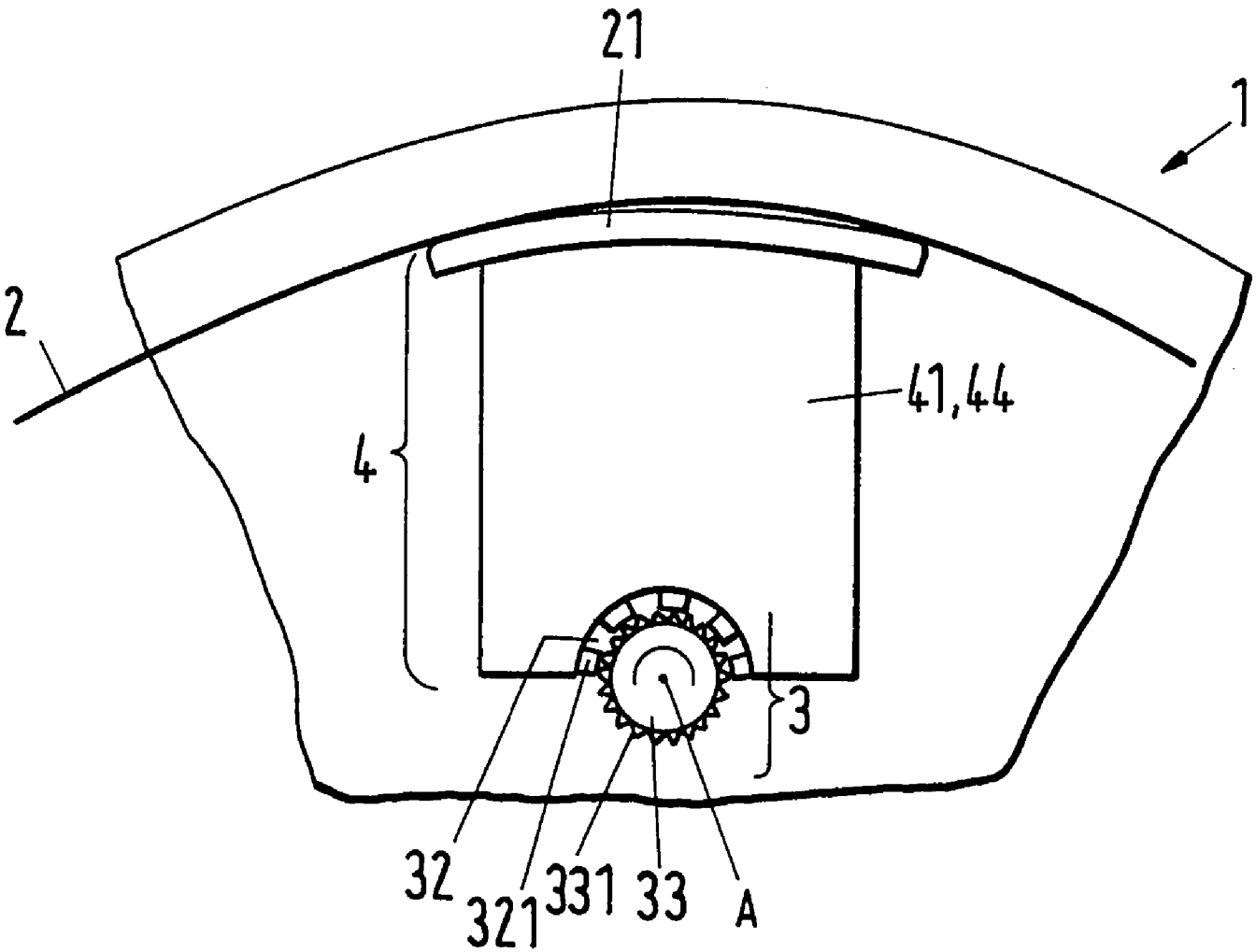
FIG. 3 shows a third exemplary embodiment in accordance with FIG. 1 with a mechanically excitable oscillating element.

In FIG. 3 a further possibility of producing resonant structural sound oscillations in a resonator body 4 of a thread carrying apparatus 1 is illustrated with reference to a third exemplary embodiment in accordance with FIG. 1. In the exemplary embodiment which is illustrated in FIG. 3 the thread carrying apparatus 1 has a mechanically excitable oscillating element 44. The excitation means 3 include, for example, a semicircular recess 32 in the oscillating element 44, the curved surface of which has a structuring, which can be formed by structure elements 321, and thus imparts a predeterminable roughness to the curved surface of the recess 32. Moreover, the excitation means 3 includes a vibrator device 33 which is designed in the form of a cylinder 33 which is rotatably journalled about an axis A. In this the surface of the cylinder 33 has a toothed profile 331, which likewise imparts a predeterminable roughness to the surface of the cylinder. The vibrator device 33 is arranged with respect to the recess 32 of the oscillating element 44 in such a manner that, on a rotation of the vibrator device 33 about the axis A, the structure elements 321 cooperate frictionally with the toothed surface 331 of the vibrator device 33 in such a manner that the resonator body 4 can be excited to resonant structural sound oscillations. Through a suitable choice of the structure of the toothed profile 331 on the surface of the cylinder and/or of the structure elements 321 of the recess 32 of the oscillating element 44, the frequency of the structural sound oscillations to be produced can be tuned to the geometry of the resonator body 4.

Preferably, but not, however, necessarily, both the toothed surface 331 at the cylinder 33 and also the structure elements 321 at the recess 32 are nanostructures, preferably regular nanostructures, with it being possible to set a frequency for the excitation of resonant structural sound oscillations in the resonator body 4 through a suitable choice of the distances, that is, of the tooth graduation and/or of the grid period of the nanostructure elements 321, 331.

Furthermore, instead of a semicircular recess 32 at the oscillating element 44, the oscillating element 44 can also have a differently shaped surface region, for example a flat surface region with structure elements 321 which are in frictional contact with the vibrator device 33. The vibrator device 33 need not be designed in the form of a cylinder which is rotatably journalled about an axis A; but rather, the vibrator device 33 can, for example, also be a frictional circular area or a device which for example executes a periodic translational movement. Especially, it is also possible for the vibrator device 33 to be immovably arranged and for the resonator body 4 to be moved relative to the vibrator device 33, or even for the resonator body 4 and the vibrator device 33 to both be movable with respect to one another with frictional contact.

Figure 4:
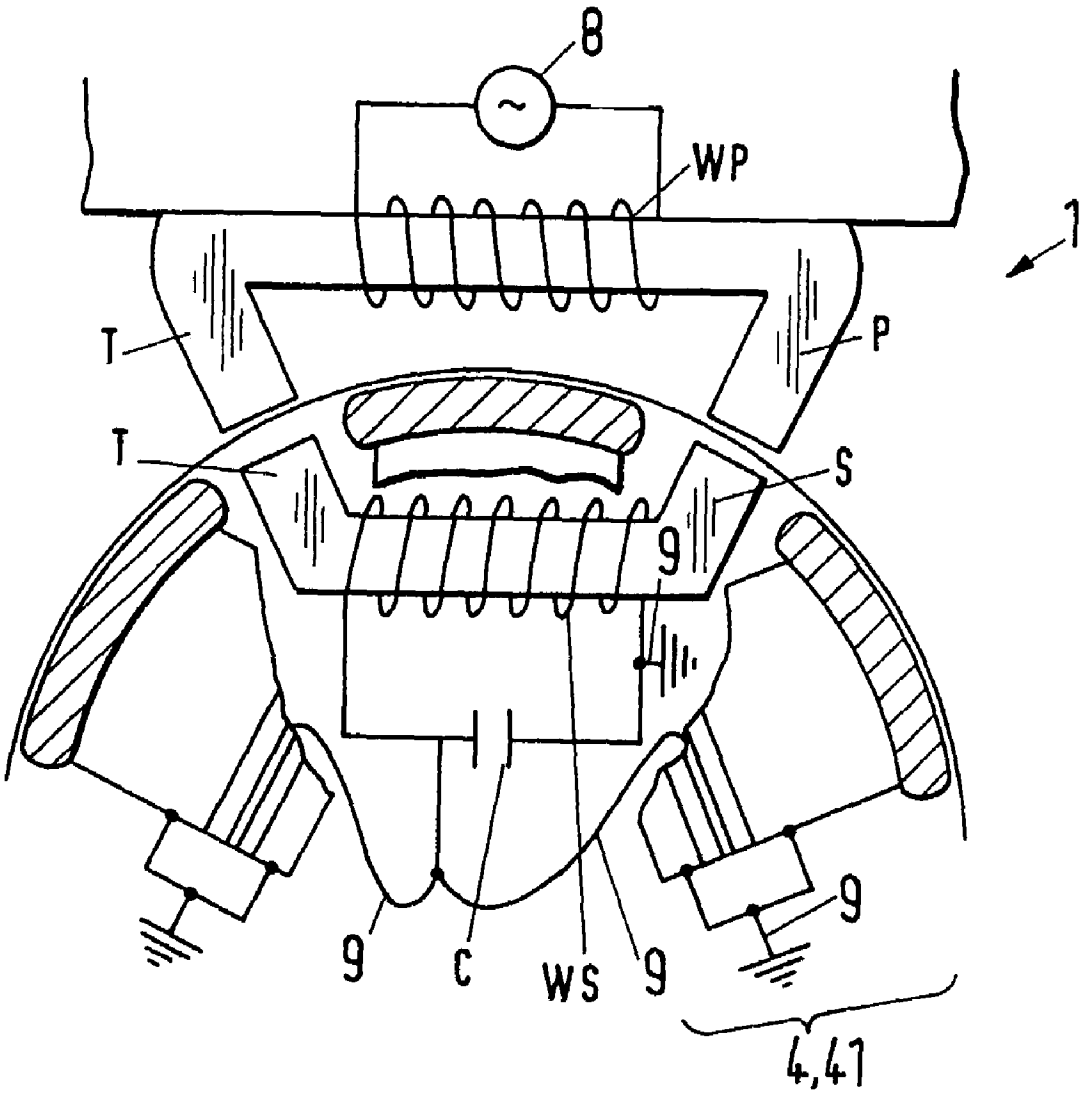
FIG. 4 shows a thread carrying apparatus with an electromagnetic transmission device.

If the thread carrying apparatus 1 includes an electromagnetically excitable oscillating element, so that the excitation means 3 for exciting the resonant structural sound oscillations must be supplied with electrical energy, then the electromagnetic energy can be coupled in a wireless or wire-free manner, by means of a transmission device T as is schematically illustrated in FIG. 4. Advantageously, but not necessarily, the transmission device T in accordance with FIG. 4 is a transformer device, in particular a resonant transformer, with a primary winding core P and a secondary winding core S which is galvanically separate from it, and which respectively include, in a manner which is known per se, a primary winding WP and a secondary winding WS. On the primary side and/or on the secondary side a resonant electrical circuit is formed through the use of known electrical components C, in a manner which is known per se, and is connected to one or more electromagnetically excitable oscillating elements 41 via supply lines 9 for supplying the electromagnetically excitable oscillating elements 41 with electrical energy. For transmitting the electrical energy the transformer arrangement T is connected to the electrical energy source 8 at the primary side, so that an electrical current of suitable frequency, especially with the frequency of the resonant structural sound oscillations to be generated, can be fed into the primary winding WP by the electrical energy source 8, and can then be supplied to the electromagnetically excitable oscillating element 41 in a known manner through inductive coupling via the secondary winding WS.

Figure 5:
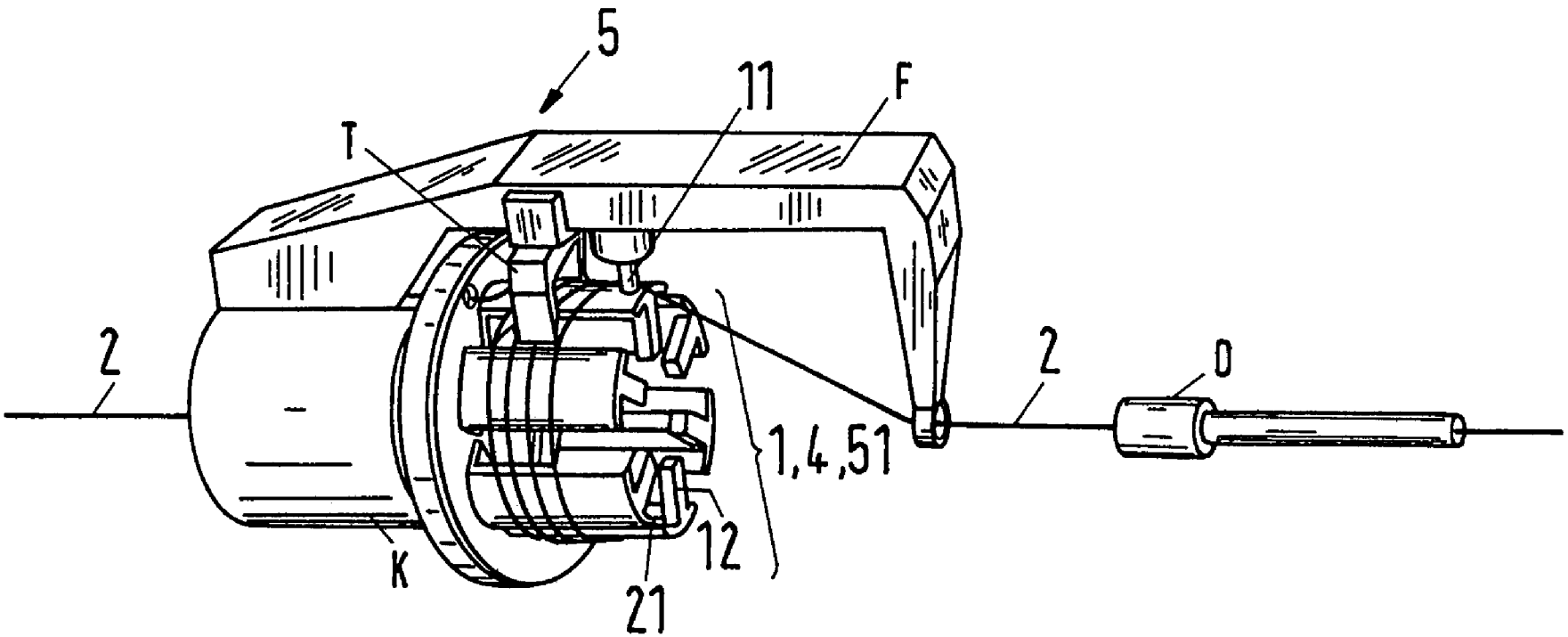
FIG. 5 shows a thread carrying apparatus as a thread drum of a drum store of a weaving machine.

As illustrated in FIG. 5, in a preferred exemplary embodiment of the resonator body 4, the thread carrying apparatus 1 can be formed by the thread drum 51 of a drum store 5 of a textile machine, in particular of a weaving machine. The drum store 5 includes as essential parts a drum body K which carries the thread drum 51 and which is preferably stationarily, i.e. not rotatably, arranged in the drum store 5, as well as a thread guiding device F, via which the thread can be supplied in a known manner from the thread drum 51 to a weft thread nozzle D. Furthermore, the drum store 5 includes a thread guiding tube which is not shown in FIG. 5 and which winds up the thread 2, especially the weft thread 2, onto the thread drum 51 in a rotating movement around the thread drum 51. A stopper pin 11 releases the weft thread 2, which is wound up onto the thread drum 51, at a predeterminable time point, so that the weft thread 2 can be supplied to the weft thread nozzle D for further processing.

In the operating state the weft thread 2 is abruptly drawn off at a high speed through the weft thread nozzle D, which is charged with compressed air, after release by the stopper pin 11. In this arrangement the friction between the thread drum 51 and the weft thread 2 during the drawing off of the thread is an essential limiting factor for the weft insertion speed and thus ultimately for the performance of the weaving machine as a whole.

The thread drum 51 has a plurality of webs 12, including a thread carrying surface 21, as well as excitation means 3 which are not shown in FIG. 5. In this the thread drum with all webs 12 and thread carrying surfaces 21 forms the resonator body 4 as a whole. The excitation means 3 in the webs 12 are designed and arranged in the webs 12 in such a manner that they generate resonant structural sound oscillations in the resonator body 4, that is, in the thread drum 51 as a whole. Preferably, but not necessarily, the excitation means 3 are designed as electromagnetically excitable oscillating elements 41, in particular as piezoelectric oscillating elements 42, with the electrical energy being advantageously suppliable by means of a transmission device T, especially with a transformer arrangement T, to the electromagnetically excitable oscillating elements 41, as already described in general with reference to FIG. 4. The resonant structural sound oscillations can also be generated here through suitably arranged and suitably designed, mechanically excited, oscillating elements 44 or else through magnetostrictive oscillating elements 43.

Figure 6:
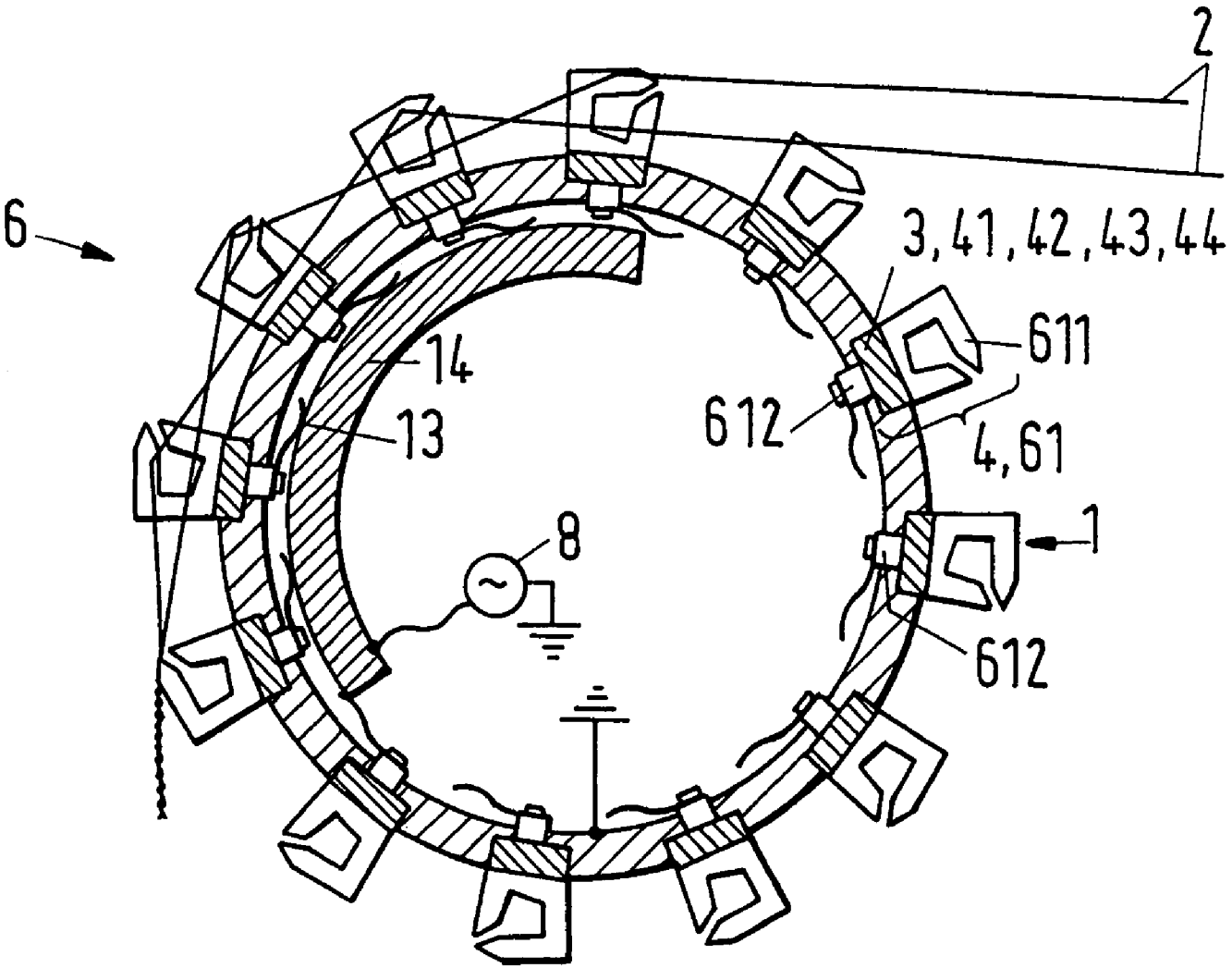
FIG. 6 shows a weaving rotor of a multiple-phase weaving machine with thread guiding elements as a thread carrying apparatus.

FIG. 6 shows a further special embodiment of a thread carrying apparatus 1 in accordance with the invention. FIG. 6 shows schematically a section through a weaving rotor 6 of a multiple-phase weaving machine with thread carrying apparatuses 1 which are designed as thread guiding elements 61. The thread guiding elements 61 are arranged in rows over the periphery of the weaving rotor 6. In this, the warp threads 2 are guided over the thread guiding elements 61 at high speed and under considerable mechanical tension for forming a shed. Since in practice 10,000 thread guiding elements 61 or more can be arranged on a single weaving rotor, the friction between the thread guiding elements 61 and warp threads 2 is one of the essential limiting factors for the performance of the multiple-phase or series shed weaving machine.

The thread carrying apparatuses 1, which are designed as thread guiding elements 61, have a thread guiding body 661 through which or over which the warp thread 2 is respectively guided, as well as excitation means 3 which are designed as electromagnetically excitable or mechanically excitable oscillation elements 41, 42, 43, 44. The excitation means 3 are preferably executed as a piezoelectric oscillating element 42, as shown in FIG. 6. In this the thread guiding elements 61 are suitably arranged at the weaving rotor 6 and fixed to the weaving rotor 6 with securing means which are not illustrated in FIG. 6. The thread guiding body 61 forms, together with the excitation means 3, the resonator body 4 of the thread carrying apparatus 1. In this arrangement the electromagnetically excitable oscillating element 41 of the thread guiding element 61 is in electrically conducting contact with an electrical energy distribution device 14 via an electrical slip contact 13. The device 14 is cylindrically designed and is arranged in the interior and/or at the outside at a periphery of the weaving rotor 6, and is preferably arranged concentrically to the latter. The electrical energy distribution device 14 is in connection with an electrical energy source 8 so that the electromagnetically excitable oscillating element 41 of the thread guiding element 61 can be supplied with electrical energy in the form of an alternating voltage or of an alternating current respectively of suitable frequency. The resonator body 4 of the thread guiding element 61 can thus be excited, as already explained, to resonant structural sound oscillations, through which the friction between the warp threads 2 and the thread guiding element 61 can be reduced to a value near zero.

Figure 7:
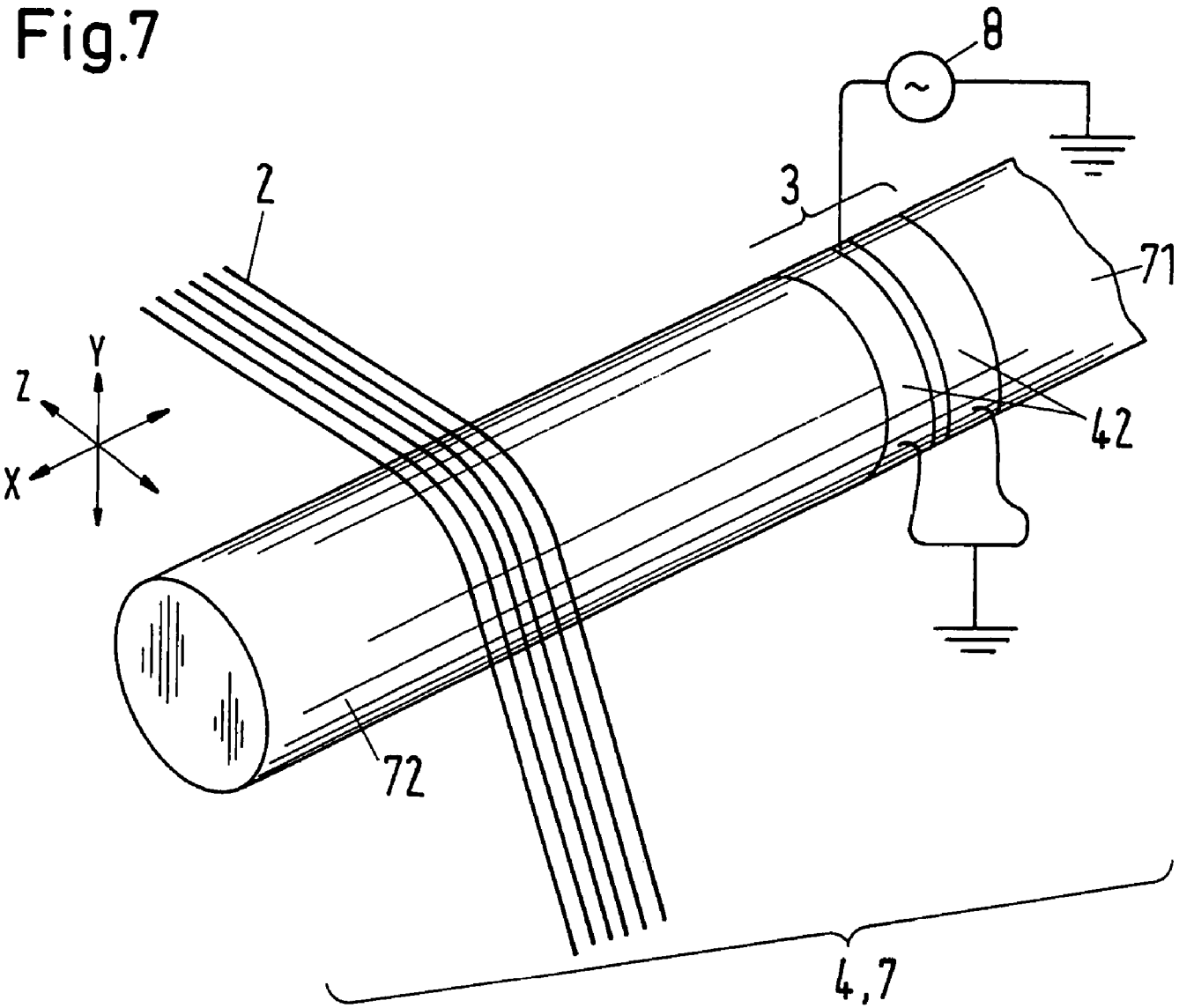
FIG. 7 shows a thread deflection apparatus with a piezoelectric oscillating element.

Finally, a thread deflection apparatus 7, over which a thread 2 can be passed for deflection, is illustrated in FIG. 7. In this the thread deflection apparatus can, as schematically shown in FIG. 7, be designed in particular, but not necessarily, cylindrically. The thread deflection apparatus 7 includes an excitation means 3, in particular a piezoelectric oscillating element 42, which is arranged between a counter-piece 71 and a thread carrying section 72. Thus the thread carrying section 72 together with the counter-piece 71 and the excitation means 3 form the resonator body 4 of the thread carrying apparatus 1. In this the piezoelectric oscillating element 42 is suitably connected, for example via slip contacts, to an electrical energy source 8 for being supplied with electrical energy. In this arrangement it is possible, as indicated by the coordinate system in FIG. 7, for different oscillation types, thus for example transversal oscillations in the Z or Y direction or else longitudinal oscillations in the X direction, to be generated by the piezoelectric oscillating element 42. It is especially also possible for one or more oscillation types, for example also torsional oscillations, to be generated at the same time in the resonator body 4 of the thread carrying apparatus 1.

In addition, the thread deflection apparatus 7 which is shown in FIG. 7 can also be excited in analogy with the above explained special exemplary embodiments of thread carrying apparatuses 1 with excitation means 3 other than a piezoelectric oscillating element 42, for example with a mechanical, a magnetostrictive, an electrostrictive or another excitation means 3 which is suitable for generating resonant structural sound oscillations in the resonator body 4 of the thread deflection apparatus 7.

For use in practice a modification of the standing wave pattern can be advantageous for the further reduction of the friction. This can be realized for example in that the resonator body 4 is suitably acted on with a plurality of excitation frequencies and/or different oscillation forms at the same time and the excitation frequencies are variable in a predeterminable frequency range in dependence on the time.

With the thread carrying apparatus in accordance with the invention an apparatus for the guiding of a thread is proposed which is adapted, through excitation of a resonator body of the thread carrying apparatus to resonant structural sound oscillations, in particular in the ultrasonic range above approximately 18 kHz, to reduce the friction between the thread and a thread carrying surface of the thread carrying apparatus to a minimum. The friction can be reduced to values which are approximately so small as to be no longer measurable. This is achieved among other things in that the thread is completely uniformly charged with vibrations along the entire length with which it lies in contact at the thread carrying surface of the thread carrying element. This means that both the amplitude of the vibratory movement and the acceleration forces which are exerted on the thread are not transmitted to the thread point-wise at one or a few locations, as is known from the prior art, but rather the transmission takes place over the entire length of the thread, over which it is in frictional contact with the thread carrying element. In particular damaging bending stresses, such as arise with point-wise oscillation excitation, are thereby also completely avoided, which plays a considerable role, above all with very sensitive threads, in particular in threads which are not very resistant to tearing. Through the particularly simple design of the thread carrying apparatus in accordance with the invention the latter is little prone to disturbances, is easy to maintain and is very economical to realize. In this the thread carrying apparatus can be used very flexibly in many fields, not only in the field of textile machines.

The invention claimed is:

1. Thread carrying apparatus for a weaving machine at which a thread lies in contact or passes along the thread carrying apparatus with friction in the operating state, with the thread carrying apparatus including excitation means for producing oscillations which reduce the frictional force between the thread and the thread carrying apparatus, including a resonator body at which the thread lies in contact or passes along with friction in the operating state, with the resonator body being designed in such a manner that the excitation means produce resonant structural sound oscillations in the resonator body, in which the resonator body is formed by a thread drum of a drum store of the weaving machine.

2. Thread carrying apparatus in accordance with claim 1, in which at least one excitation means is designed as an electromagnetically oscillating element.

3. Thread carrying apparatus in accordance with claim 1, in which at least one excitation means is designed as a piezoelectric oscillating element.

4. Thread carrying apparatus in accordance with claim 1, in which at least one excitation means is designed as a magnetostrictive oscillating element.

5. Thread carrying apparatus in accordance with claim 1, in which at least one excitation means is designed as a mechanically excited oscillating element.

6. Thread carrying apparatus in accordance with claim 1, in which the resonator body comprises an electromagnetically excitable oscillating element in which the electromagnetic energy for the excitation of at least one oscillating element can be coupled in a wireless manner by means of a transmission device (T).

7. Thread carrying apparatus for a weaving machine at which a thread lies in contact or passes along the thread carrying apparatus with friction in the operating state, with the thread carrying apparatus including excitation means for producing oscillations which reduce the frictional force between the thread and the thread carrying apparatus, including a resonator body at which the thread lies in contact or passes along with friction in the operating state, with the resonator body being designed in such a manner that the excitation means produce resonant structural sound oscillations in the resonator body in which the resonator body is formed by a thread guiding element of a weaving rotor of the weaving machine.

8. Thread carrying apparatus in accordance with claim 1 or 7, in which the resonator body is formed by a thread deflection apparatus of the weaving machine.

9. A weaving machine, including a thread carrying apparatus in accordance with claim 1 or 7.

10. Thread carrying apparatus in accordance with claim 7, in which the resonator body comprises an electromagnetically excitable oscillating element in which the electromagnetic energy for the excitation of the oscillating element can be coupled in a wireless manner by means of a transmission device (T).

11. Thread carrying apparatus in accordance with claim 1 or 7 wherein the resonant structural sound oscillations have a frequency above 18 kHz.

* * * * *